US007483010B2

(12) United States Patent
Bai et al.

(10) Patent No.: US 7,483,010 B2
(45) Date of Patent: Jan. 27, 2009

(54) FRAME-VARYING ADDRESSING METHOD OF COLOR SEQUENTIAL DISPLAY

(75) Inventors: Shwang-Shi Bai, Hsinhua (TW); Ming-Yeong Chen, Hsinhua (TW); Kuo-Tung Hsu, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 615 days.

(21) Appl. No.: 11/018,674

(22) Filed: Dec. 22, 2004

(65) Prior Publication Data

US 2006/0132405 A1 Jun. 22, 2006

(51) Int. Cl.
*G09G 3/36* (2006.01)

(52) U.S. Cl. ..... 345/88; 345/87; 345/92; 345/98; 345/102

(58) Field of Classification Search ..... 345/88, 345/672, 426, 156, 611, 63, 84, 96–103, 345/673, 76, 77, 87, 92, 204, 213; 382/261, 382/154, 166, 262, 291, 169.3; 348/72, 207.1; 340/784; 358/1.9, 1.4; 315/291, 169.3
See application file for complete search history.

(56) References Cited

U.S. PATENT DOCUMENTS 4,627,004 A * 12/1986 Cool et al. ..... 358/1.9
4,897,806 A * 1/1990 Cook et al. ..... 345/426
4,941,040 A * 7/1990 Pocock et al. ..... 725/116
5,025,400 A * 6/1991 Cook et al. ..... 345/611
5,144,688 A * 9/1992 Bovir et al. ..... 382/166
5,233,338 A * 8/1993 Surguy ..... 345/88
5,475,420 A * 12/1995 Buchin ..... 348/72
5,563,962 A * 10/1996 Peters et al. ..... 382/261
5,731,802 A * 3/1998 Aras et al. ..... 345/692
6,057,824 A * 5/2000 Katakura et al. ..... 345/100
6,249,265 B1 * 6/2001 Tajima et al. ..... 345/63
6,476,824 B1 * 11/2002 Suzuki et al. ..... 345/690
6,700,562 B1 * 3/2004 Knapp et al. ..... 345/98
6,864,900 B2 * 3/2005 Wasserman et al. ..... 345/672
7,102,610 B2 * 9/2006 Ludden ..... 345/98
2002/0047824 A1 * 4/2002 Handschy et al. ..... 345/97
2002/0180742 A1 * 12/2002 Hamid ..... 345/531
2003/0035123 A1 * 2/2003 Ramanujan et al. ..... 358/1.4
2003/0076990 A1 * 4/2003 Brand ..... 382/154
2003/0236458 A1 * 12/2003 Hochman ..... 600/431
2004/0207592 A1 * 10/2004 Ludden ..... 345/96
2004/0212632 A1 * 10/2004 Inada et al. ..... 345/690
2005/0001812 A1 * 1/2005 Amundson et al. ..... 345/107
2005/0104816 A1 * 5/2005 Kimura et al. ..... 345/76
2005/0156839 A1 * 7/2005 Webb ..... 345/87
2005/0168437 A1 * 8/2005 Carl et al. ..... 345/156

(Continued)

*Primary Examiner*—Prabodh M. Dharia
(74) *Attorney, Agent, or Firm*—Rabin & Berdo, PC

(57) ABSTRACT

A frame-varying addressing method of a color sequential liquid crystal display is disclosed for display of successive frames. Each of the frames is composed of three subframes, and each of the subframes is composed of a plurality of scan lines. According to the frame-varying addressing method of the invention, the addressing sequence of scan lines for display of any frame or subframe is arranged in the same direction as those for display of its adjacent frames or subframes, and is selected to be different from those for display of its adjacent frames or subframes. Further, the addressing sequence for the frame (subframe) and its adjacent frames (subframes) can be periodically or randomly selected, so as to effectively balance or greatly eliminate the spatial intensity variations due to inconsistent response times at different portions of the panel.

15 Claims, 4 Drawing Sheets

| Frame | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Line | 1 | 2 | 3 | 4 | 1 | 2 | 3 | 4 | 1 | 2 | 3 | 4 | 1 | 2 | 3 | 4 |
| Line | 2 | 3 | 4 | 1 | 2 | 3 | 4 | 1 | 2 | 3 | 4 | 1 | 2 | 3 | 4 | 1 |
| Line | 3 | 4 | 1 | 2 | 3 | 4 | 1 | 2 | 3 | 4 | 1 | 2 | 3 | 4 | 1 | 2 |
| Line | 4 | 1 | 2 | 3 | 4 | 1 | 2 | 3 | 4 | 1 | 2 | 3 | 4 | 1 | 2 | 3 |

U.S. PATENT DOCUMENTS

2005/0225545 A1* 10/2005 Takatori et al. ..... 345/204
2005/0243176 A1* 11/2005 Wu et al. ..... 348/207.1
2005/0248553 A1* 11/2005 Feng et al. ..... 345/204
2006/0125748 A1* 6/2006 Yang et al. ..... 345/88
2006/0250336 A1* 11/2006 Wood ..... 345/84
2006/0280360 A1* 12/2006 Holub ..... 382/162

* cited by examiner

| Frame | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Line | 1 | 2 | 3 | 4 | 1 | 2 | 3 | 4 | 1 | 2 | 3 | 4 | 1 | 2 | 3 | 4 |
| Line | 2 | 3 | 4 | 1 | 2 | 3 | 4 | 1 | 2 | 3 | 4 | 1 | 2 | 3 | 4 | 1 |
| Line | 3 | 4 | 1 | 2 | 3 | 4 | 1 | 2 | 3 | 4 | 1 | 2 | 3 | 4 | 1 | 2 |
| Line | 4 | 1 | 2 | 3 | 4 | 1 | 2 | 3 | 4 | 1 | 2 | 3 | 4 | 1 | 2 | 3 |

FRAME-VARYING ADDRESSING METHOD OF COLOR SEQUENTIAL DISPLAY

BACKGROUND OF THE INVENTION

1. Field of the Invention

The invention relates in general to an addressing method of a color sequential display and more particularly to a frame-varying addressing method of a color sequential liquid crystal display (LCD).

2. Description of the Related Art

In recent years, the flat panel display (FPD) industry has been focused on developing liquid crystal displays (LCDs), especially on developing thin film transistor (TFT) LCDs, and hoping to replace the role of cathode ray tube (CRT) displays in video applications. Each pixel on a TFT LCD is provided with a switching transistor for enabling image data to be written into a panel of the display.

One way of displaying the TFT LCD is to use color sequential technology. A typical frame for displaying a color image is divided into three subframes for the three primary colors of red, green and blue, and each subframe is further divided into a subframe writing period and a subframe illumination period. To display the color image, the TFT LCD is first addressed line by line by display drivers to write image data of the corresponding primary color into the pixels during the corresponding subframe writing period, in the meanwhile, capacitors located at each pixel are charged to set the liquid crystals within the pixels to their light transmittive states for displaying appropriate gray values of the corresponding primary color. Then, during the subframe illumination period, light sources, such as light emitting diode (LEDs), are turned on to display the corresponding primary color component of the color image, such that these three primary color components can be compositely perceived as a full-color image. However, the color sequential display is likely to suffer spatial intensity variations due to insufficient response time, which may cause the bottom portion of the TFT LCD to appear dimmer.

Hence, there is a need to provide a novel addressing method to effectively eliminate the spatial intensity variations associated with the conventional color sequential display.

SUMMARY OF THE INVENTION

It is therefore an object of the invention to provide a novel frame-varying addressing method of a color sequential liquid crystal display for display of successive frames, so as to effectively minimize the spatial intensity variations associated with the conventional addressing method.

The invention achieves the above-identified object by providing a frame-varying addressing method of a color sequential liquid crystal display for display of successive frames. Each of the frames is composed of three subframes, and each of the subframes is composed of a plurality of scan lines. According to the frame-varying addressing method of the invention, the addressing sequence of scan lines for display of any frame or subframe is arranged in the same direction as those for display of its adjacent frames or subframes, and is selected to be different from those for display of its adjacent frames or subframes. Further, the addressing sequence of scan lines for the frame (subframe) and its adjacent frames (subframes) can be periodically or randomly selected, so as to effectively balance or greatly eliminate the spatial intensity variations due to inconsistent response times at different portions of the panel, which are associated with the conventional addressing method.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
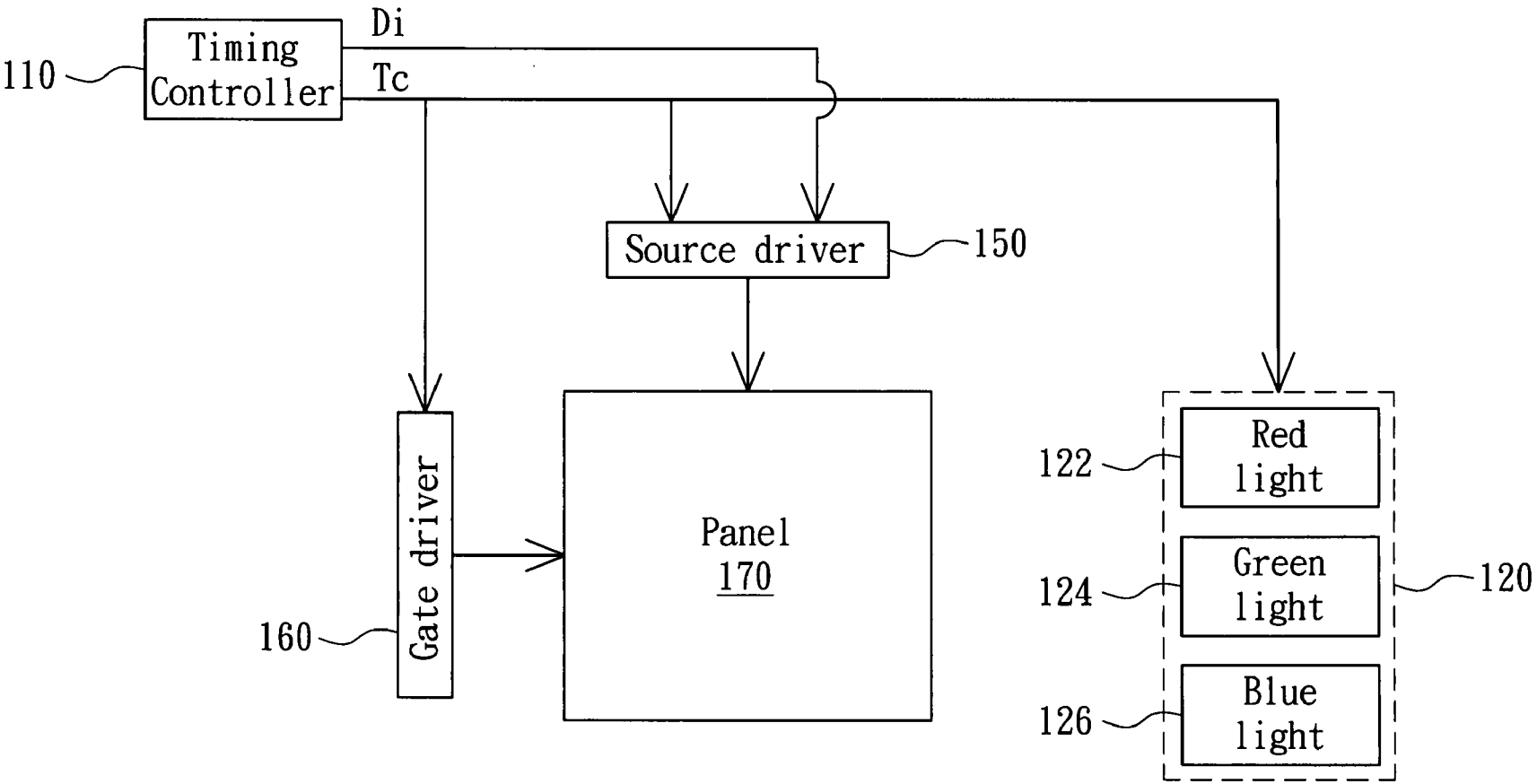
FIG. 1 shows a color sequential liquid crystal display 100.

FIG. 1 shows a color sequential display 100. The color sequential display 100, such as a color sequential liquid crystal display (LCD), includes a timing controller 110, a backlight 120, display drivers including a source driver 150 and a gate driver 160, and a panel 170. The timing controller 110 outputs timing signals Tc to the source driver 150, the gate driver 160 and the backlight 120, and outputs image data Di to the source driver 150. The panel 170 includes pixels that are arranged in a matrix of rows and columns, and receives the image data Di for writing into the pixel. The backlight 120 includes a red light source 122, a green light source 124 and a blue light source 126 for illumination of the panel 170. In the color sequential display 100, a frame period is divided into three subframes, and each subframe is provided to sequentially display one of the three primary color components of red, green and blue.

Figure 2:
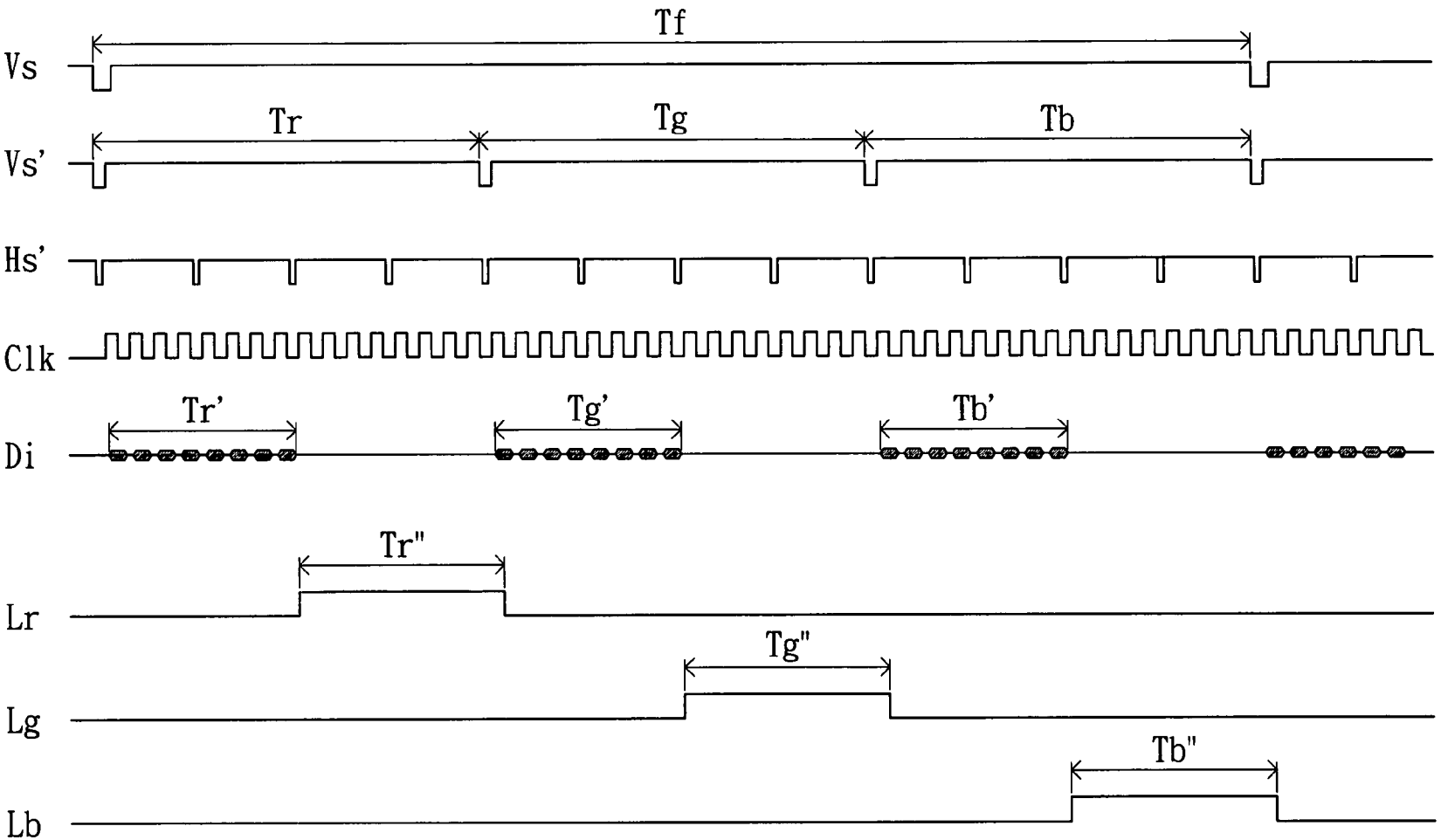
FIG. 2 shows the timing signals of the color sequential LCD 100.

FIG. 2 shows the timing signals of the color sequential display 100. A vertical synchronization signal Vs indicates the start of each frame, with the period of the frame denoted as Tf. A subframe vertical synchronization signal Vs' indicates the start of each subframe, with the period of each of the three successive subframes denoted as Tr, Tg, and Tb. Further, each subframe is divided into a subframe writing period and a subframe illumination period. The pixels of the panel 170 are addressed line by line by the gate drivers 160, with the image data Di written to the corresponding scan lines via the source driver 150 in the corresponding subframe writing periods. For example, as shown in FIG. 2, at the start of the red subframe Tr, during the read subframe writing period Tr', red components of the image data Di are written to the pixels of the panel 170 according to a pixel clock CLK. Upon completion, during the red subframe illumination period Tr", a red light 122 within the backlight 120 is turned on by a red light enable signal Lr for a preset duration, in order to illuminate the panel 170 for display of the red components of the frame image. Next, during the green subframe Tg, green components of the image data Di are written to the pixels of the panel 170 according to CLK during the green subframe writing period Tg', and a green light 124 within the backlight 120 is turned on by a green light enable signal Lg during the green subframe illumination period Tg" to illuminate the panel 170 for display of the green components of the frame image. Thereafter, during the blue subframe Tb, blue components of the image data Di are written to the pixels of the panel 170 according to CLK during the blue subframe writing period Tb', and a blue light 126 within the backlight 120 is turned on by a blue light enable signal Lb during the green subframe illumination period Tb" to illuminate the panel 170 for display of the blue components of the frame image. Upon completion of the illumination of the blue light 126, the three primary color components of the frame image can be compositely perceived as a full-color image since the color sequential technology is performed at a sufficiently high frequency, for example, 60 times per second.

Conventionally, in each and every subframe, the pixels of the panel 170 are sequentially addressed line by line by gate drivers from top to bottom or from bottom to top. However, this will result in spatial intensity variations due to inconsistent pixel response time at different portions of the panel 170.

Figure 3:
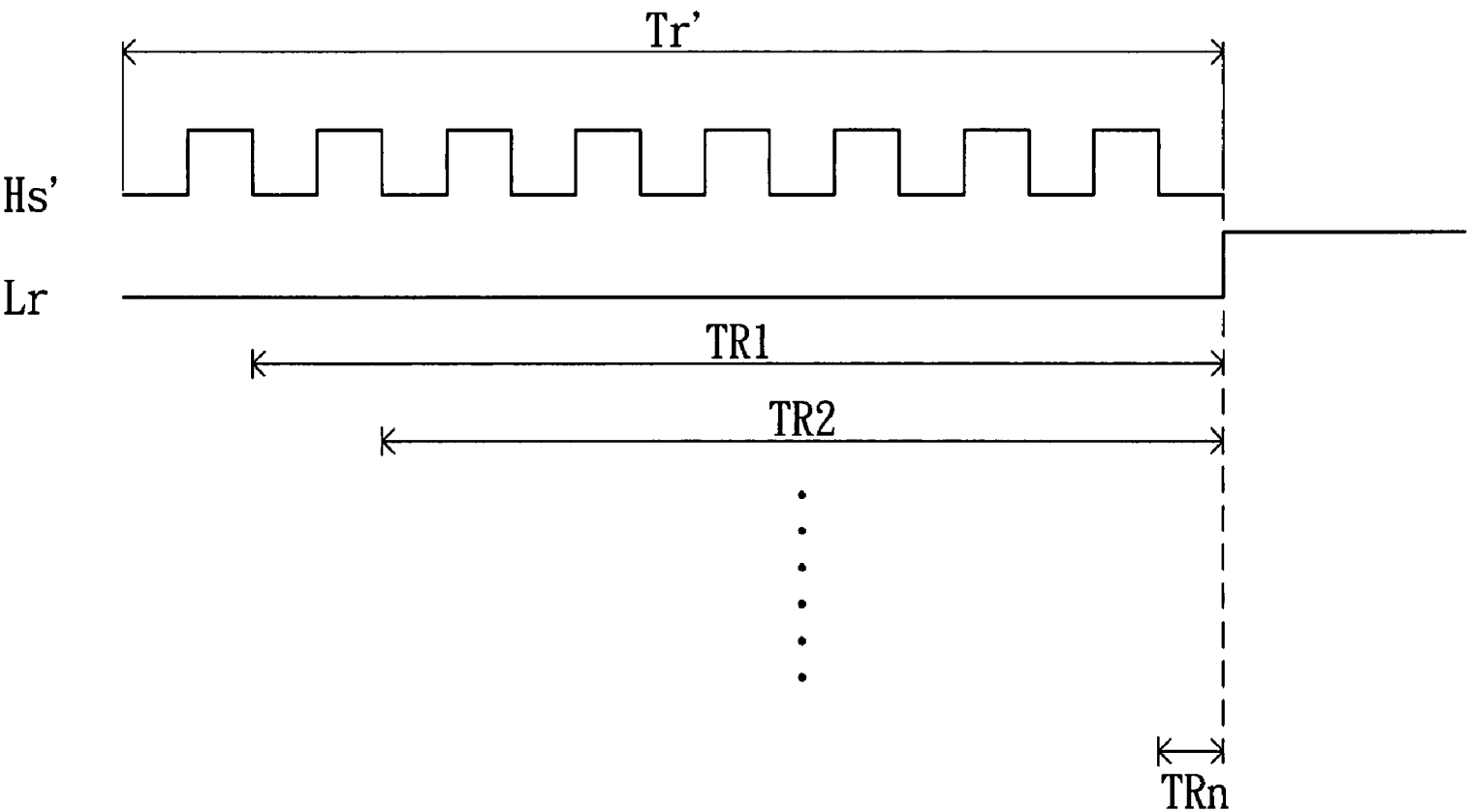
FIG. 3 illustrates the pixel response time associated with a conventional addressing method during a subframe writing period of a subframe.

FIG. 3 illustrates the pixel response time associated with the conventional line addressing method during a subframe writing period of a subframe, for example, the red subframe. As shown in FIG. 3, it is supposed that the line addressing sequence is from top to bottom, that is, the top line of the panel 170 is addressed first, and the bottom line of the panel 170 is addressed last. Since the pixels on the top line are first addressed, the pixels on the top line would have sufficient time to respond, that is, have a longest pixel response time of TR1 that is substantially close to the red subframe writing period Tr'. In turn, the pixels on the next line would have a pixel response time of TR2 that is a little shorter that TR1. Yet, the pixels on the following lines would have even shorter pixel response times than TR2. Since the pixels on the bottom line are addressed last and a substantial part of the red subframe writing period has elapsed; the pixels on the bottom line would have a shortest pixel response time of TRn. The response time TRn is significantly less than TR1. Therefore, the pixels on the bottom lines, in case the line addressing sequence is from top to bottom, often do not have sufficient response times to appropriately charge the capacitors that are positioned at each pixel to set liquid crystals in the pixels to their light transmittive states for displaying the appropriate gray value. Consequently, the bottom portion of the panel 170 in the conventional color sequential display often appears dimmer.

To eliminate the spatial intensity variations, this invention provides a novel frame-varying line addressing method, which periodically or randomly alters the position of the first scan line in successive frames or subframes. With this invention, the last scan line of the panel 170 in the successive frames or subframes will not necessarily be located at the same portion of the panel 170. Rather, the last scan line of the panel 170 in successive frames or subframes can be different in position, thus effectively balancing the spatial intensity variations due to inconsistent response time at different portions of the panel. Therefore, the spatial intensity variations can be balanced over the entire area of the panel 170.

Figures 4A, 4B:
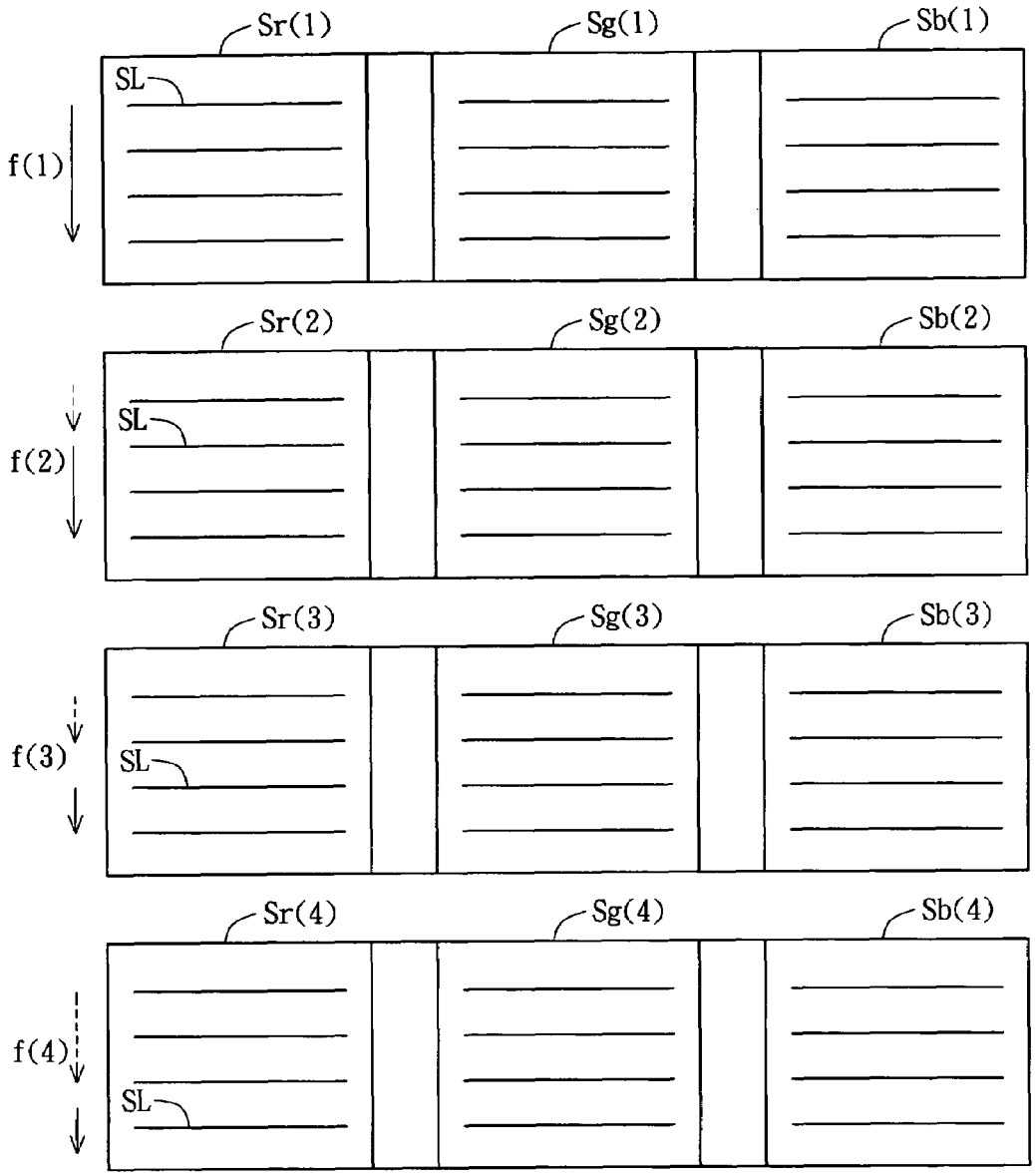
FIG. 4A and FIG. 4B show an addressing sequence of scan lines for successive frames according an embodiment of the invention.

FIG. 4A is a line addressing method of a color sequential display according to an embodiment of the invention. Take four successive frames f(1), f(2), f(3) and f(4) for example, where each of the frames includes four lines 1, 2, 3 and 4 that are sequentially arranged on the panel from top to bottom, and each of the frames is respectively divided into red, green and blue subframes Sr, Sg and Sb, the line addressing sequence for each of the frames is arranged the same direction as each others and is selected to be different from the others so as to balance the spatial intensity variations due to inconsistent response times at different portions of the panel.

For example, in the frame f(1), the addressing sequence of scan lines may start from line 1, which is indicated by SL, and continued with line 2, line 3 and line 4. In this case, the addressing sequence of scan lines for three subframes Sr(1), Sg(1) and Sb(1) of the frame f(1) also follow the same addressing sequence of scan lines as the frame (1). That is, the addressing sequence of scan lines for the red subframe Sr(1) having a period Tr follows the addressing sequence of lines 1, 2, 3 and 4; the line addressing sequence of scan lines for the green subframe Sg(1) having a period Tg follows the addressing sequence of lines 1,2, 3 and 4; and the addressing sequence of scan lines for the blue subframe Sb(1) having a period Tb follows the addressing sequence of lines 1, 2, 3 and 4.

Subsequently, in the following frame f(2), the addressing sequence of scan lines is arranged in the same direction of that for the frame f(1), and is selected to be different from that for the frame f(1). For example, the addressing sequence of scan lines may start from line 2, which is indicated by SL, and continued with line 3, line 4 and back to line 1. That is, the addressing sequence of scan lines for the red subframe Sr(2) having a period Tr follows the addressing sequence of lines 2, 3, 4 and 1; the addressing sequence of scan lines for the green subframe Sg(2) having a period Tg follows the addressing sequence of lines 2, 3, 4 and 1; and the addressing sequence of scan lines for the blue subframe Sb(2) having a period Tb follows the addressing sequence of lines 2, 3, 4 and 1.

Subsequently, in the following frame f(3), the addressing sequence of scan lines is arranged in the same direction as those for the frame f(1) and the frame f(2), and is selected to be different from those for the frame f(1) and the frame f(2). For example, the addressing sequence of scan lines may start from line 3, which is indicated by SL, and continue with line 4 and back to line 1 and line 2. That is, the addressing sequence of scan lines for the red subframe Sr(3) having a period Tr follows the addressing sequence of lines 3, 4, 1 and 2; the addressing sequence of scan lines for the green subframe Sg(3) having a period Tg follows the addressing sequence of lines 3, 4, 1 and 2; and the addressing sequence of scan lines for the blue subframe Sb(3) having a period Tb follows the addressing sequence of lines 3, 4, 1 and 2.

Finally, in the frame f(4), the addressing sequence of scan lines is arranged in the same direction as those for the frame f(1), the frame f(2) and the frame f(3), and is selected to be different from those of the frame f(1), the frame f(2) and the frame f(3). For example, the addressing sequence of scan lines may start from line 4, which is indicated by SL, and back to line 1, line 2 and line 3. That is, the addressing sequence of scan lines for the red subframe Sr(4) having a period Tr follows the addressing sequence of lines 4, 1, 2 and 3; the line addressing sequence for the green subframe Sg(4) having a period Tg follows the addressing sequence of lines 4, 1, 2 and 3; and the addressing sequence of scan lines for the blue subframe Sb(4) having a period Tb follows the addressing sequence of lines 4, 1, 2 and 3.

Thereafter, the addressing sequence of scan lines for successive frames may periodically repeat the addressing sequence of scan lines for the preceding frames. With this frame-varying addressing sequence, the spatial intensity variations due to inconsistent response times at different portions of the panels can be effectively balanced or greatly eliminated.

FIG. 4B is a table illustrating the addressing sequence of scan lines for successive 16 frames. As can be readily seen, every scan line on the panel can be the last line addressed during a subframe, therefore, the spatial intensity variations associated with the conventional line addressing sequence can be effectively balanced out or greatly eliminated.

Although the invention has been described in accordance to a preferred embodiment, however, without departing from the spirit and scope of the claims, the invention may also encompass other modifications. For example, the addressing sequence of scan lines for each of the subframes within the same frame does not have to coincide with each others and can be selected to be different from each others. For instance, in the frame f(2), the addressing sequence of scan lines for the red subframe Sr(2) can be different from those for the green subframe Sg(2) and the blue subframe Sb(2), so as to further balance the inconsistent response times at different portions of the panel.

Also, the panel can be segmented into a plurality of units, with each of the units composing of a plurality of scan lines. In this case, the addressing sequence of units and the addressing sequence of scan lines within the units can also be periodically or randomly varied, so as to balance the spatial intensity variations due to inconsistent response times at different portions of the panel.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A frame-varying addressing method of a color sequential display for display of successive frames, wherein each of the frames is composed of three subframes and each of the subframes is composed of a plurality of scan lines, the addressing method comprising:

displaying a first frame including a first group of successive scan lines with a first addressing sequence of scan lines; and displaying a second frame including a second group of successive scan lines with a second addressing sequence of scan lines, wherein the first group of successive scan lines is corresponding to the second group of successive scan lines, the second frame is successive to the first frame, and the second addressing sequence of scan lines is arranged in the same direction as the first addressing sequence of scan lines and is selected to be different from the first addressing sequence of scan lines, so as to balance spatial intensity variations due to inconsistent response times at different portions of the color sequential display.

2. The method of claim 1, wherein the addressing sequence of scan lines for each of the subframes in the first frame is selected to be different from each other, and the addressing sequence of scan lines for each of the subframes in the second frame is selected to be different from each other.

3. The method of claim 1, wherein the plurality of scan lines are sequentially arranged on a panel of the color sequential display from top to bottom.

4. The method of claim 1, wherein the plurality of scan lines are sequentially arranged on a panel of the color sequential display from bottom to top.

5. The method of claim 1, wherein the second addressing sequence of scan lines is shifted from the first addressing sequence of scan lines by a predetermined number of scan lines.

6. The method of claim 1, wherein the second addressing sequence of scan lines is shifted from the first addressing sequence of scan lines by a random number of scan lines.

7. The method of claim 1, further comprising:

displaying a third frame with a third addressing sequence of scan lines, wherein the third frame is successive to the second frame, the third addressing sequence of scan lines is arranged in the same direction as the first addressing sequence of scan lines and the second addressing sequence of scan lines and is selected to be different from the first addressing sequence of scan lines and the second addressing sequence of scan lines, so as to further balance spatial intensity variations due to inconsistent response times at different portions of the color sequential display.

8. A frame-varying addressing method of a color sequential display for display of successive frames, wherein each of the frames is composed of three subframes, each of the subframes is composed of a plurality of units, and each of the units is composed of a plurality of scan lines, the addressing method comprising:

displaying a first frame including a first group of successive scan lines with a first addressing sequence of units and with a first addressing sequence of scan lines; and displaying a second frame including a second group of successive scan lines with a second addressing sequence of units and with a second addressing sequence of scan lines, wherein the first group of successive scan lines is corresponding to the second group of successive scan lines, the second frame is successive to the first frame, the second addressing sequence of units is selected to be different from the first addressing sequence of units, and the second addressing sequence of scan lines is selected to be in the same direction as the first addressing sequence of scan lines, so as to balance spatial intensity variations due to inconsistent response times at different portions of the color sequential display.

9. The method of claim 8, wherein the addressing sequence of scan lines for each of the subframes in the first frame is selected to be different from each other, and the addressing sequence of scan lines for each of the subframes in the second frame is selected to be different from each other.

10. The method of claim 8, wherein the second addressing sequence of units is shifted from the first addressing sequence of units by a predetermined number of units.

11. The method of claim 8, wherein the second addressing sequence of units is shifted from the first addressing sequence of units by a random number of units.

12. The method of claim 10, wherein the second addressing sequence of scan. lines is shifted from the first addressing sequence of scan lines by a predetermined number of scan lines.

13. The method of claim 10, wherein the second addressing sequence of scan lines is shifted from the first addressing sequence of scan lines by a random number of scan lines.

14. The method of claim 11, wherein the second addressing sequence of scan lines is shifted from the first addressing sequence of scan lines by a predetermined number of scan lines.

15. The method of claim 11, wherein the second addressing sequence of scan lines is shifted from the first addressing sequence of scan lines by a random number of scan lines.

* * * * *